US005490632A

United States Patent [19]

Haynes

[11] Patent Number: 5,490,632

[45] Date of Patent: Feb. 13, 1996

[54] VENTING DEVICE AND METHOD

[76] Inventor: Henry T. Haynes, 105 E. G St., Jenks, Okla. 74037

[21] Appl. No.: 334,156

[22] Filed: Nov. 4, 1994

Related U.S. Application Data

[63] Continuation-in-part of Ser. No. 176,801, Dec. 30, 1993, Pat. No. 5,386,941, which is a continuation-in-part of Ser. No. 46,646, Apr. 13, 1993, Pat. No. 5,284,298.

[51] Int. Cl.[6] ..... B05B 9/00

[52] U.S. Cl. ..... 239/119; 239/124

[58] Field of Search ..... 239/104, 106, 239/110, 111, 119, 124, 126

[56] References Cited

U.S. PATENT DOCUMENTS

| | | | |
|---|---|---|---|
| 486,829 | 11/1892 | Hart | 239/259 |
| 515,210 | 2/1894 | Graves | 239/434.5 |
| 945,899 | 1/1910 | Achee | 239/434.5 |
| 1,655,222 | 1/1928 | Elze | 239/434.5 |
| 2,008,130 | 7/1935 | Damm | 239/434.5 |
| 3,180,348 | 4/1965 | Clearman | 239/251 |
| 3,643,623 | 2/1972 | Eng et al. | 239/434 |
| 3,758,033 | 9/1973 | Schurig et al. | 239/102 |
| 3,807,636 | 4/1974 | Fackler | 239/251 |
| 4,191,590 | 3/1980 | Sundheim | 239/251 |
| 4,437,314 | 3/1984 | Collin | 239/434 |
| 4,690,325 | 9/1987 | Pacht | 239/124 |
| 4,923,120 | 5/1990 | Hammelmann | 134/179 |
| 5,067,654 | 11/1991 | Paige | 239/124 |
| 5,230,471 | 7/1993 | Berfield | 239/124 |

FOREIGN PATENT DOCUMENTS

| | | | |
|---|---|---|---|
| 829648 | 1/1952 | Germany | 239/434 |
| 645720 | 11/1950 | United Kingdom | 239/119 |

*Primary Examiner*—Andres Kashnikow
*Assistant Examiner*—Lesley D. Morris
*Attorney, Agent, or Firm*—Dougherty, Hessin, Beavers & Gilbert

[57] ABSTRACT

A device and method for venting a conduit and allowing fluid flow through the vented conduit includes an upstream conduit, downstream conduit, and a support for holding the upstream and downstream conduits with their upstream and downstream passageways aligned and maintaining a gap between the adjacent ends of the conduits. The upstream passageway includes an acceleration nozzle for accelerating the velocity of the fluid flow so that the pressure exerted by the fluid on the walls of the upstream passageway is substantially reduced and the reduced pressure is maintained across the gap. The downstream conduit includes a downstream passageway which maintains the accelerated velocity of the primary fluid and which conducts accelerated fluid to a deceleration nozzle. A plurality of the devices may be connected in series and/or multiple gaps may be created between the conduits using intermediate conduits in order to create multiple gaps. When the device is depressurized and/or inactive, the gap(s) function as vents which will drain fluid from the conduits and/or prevent the creation of a vacuum or low pressure at the fluid supply which could siphon fluid from the fluid user to the fluid supply.

29 Claims, 2 Drawing Sheets

VENTING DEVICE AND METHOD

This application is a continuation-in-part of application Ser. No. 08/176,801 filed on Dec. 30, 1993 (now U.S. Pat. No. 5,386,941 issued on Feb. 7, 1995) which is a continuation-in-part of application Ser. No. 08/046,646 filed on Apr. 13, 1993 (now U.S. Pat. No. 5,284,298, issued on Feb. 16, 1994).

BACKGROUND OF THE INVENTION

This invention relates to fluid-conducting devices and more particularly, but not by way of limitation, to devices and methods for venting a conduit and allowing fluid flow through the conduit.

Vents, drains, vacuum relieving devices, and the like for fluid-conducting equipment are known and commercially available. For example, manually and pressure operated valves are used in such applications. However, such valves require manual operation and observation by a human operator and/or may be comprised of numerous interacting parts and control systems, and therefore require maintenance personnel and may be relatively expensive.

It is also known to use float tanks to prevent contamination of a fluid source or supply. For example, the water tank on a household commode is used to isolate water supply from the commode bowl. Similarly, a float tank is used at self-service car washes to isolate the community water supply lines from the soap and chemicals which are mixed with the water at the car wash. The float tank prevents backflow of the car wash chemicals into the community water supply lines when the pressure in the water supply lines is suddenly reduced, as may occur when fire trucks begin pumping from the water supply. Such float tanks are relatively expensive and require maintenance personnel.

Therefore, there is a need for a venting device which may be used to continuously, automatically, and passively vent, drain, and prevent the formation of vacuums in fluid-conducting conduits; and which includes no moving parts and is inexpensive to manufacture, install, and maintain.

SUMMARY OF THE INVENTION

The prevent invention is contemplated to overcome the foregoing deficiencies and meet the above-described needs. In accomplishing this, the present invention provides a novel and improved device and method for venting a conduit.

The inventive venting device includes an upstream conduit, a downstream conduit, and support means. The upstream conduit has a first end connectable to a fluid source, a second end, and an upstream passageway extending through the first and second ends. The upstream passageway includes an acceleration nozzle disposed in the upstream passageway for accelerating the velocity of the fluid flow in the upstream passageway so that the pressure exerted by the fluid on the walls of the upstream passageway is substantially reduced; and an upstream throat, extending between the acceleration nozzle and the second end of the upstream conduit, for maintaining the accelerated velocity of the fluid flow from the acceleration nozzle.

The downstream conduit has a first end connectable to a fluid user, a second end, and a fluid passageway extending through the first and second ends. The downstream passageway includes a deceleration nozzle disposed in the downstream passageway for decelerating the velocity of the fluid flow; and a downstream throat extending between the deceleration nozzle and the second end of the downstream conduit for receiving the accelerated fluid from the upstream throat and maintaining the accelerated fluid at substantially the same velocity as the fluid exiting the upstream throat.

The support means is used for holding the upstream and downstream conduits with the upstream and downstream throats aligned and for maintaining a gap between the upstream and downstream conduits and between the upstream and downstream throats. The gap provides the venting mechanism of the invention.

Several of the venting devices may be connected in series. An intermediate conduit may be placed between the upstream and downstream conduits. The intermediate conduit has an intermediate throat extending between an inlet end and an outlet end. The inlet end of the intermediate conduit receives the accelerated fluid from the upstream throat and maintains the received fluid at substantially the same velocity through the intermediate throat as the fluid exiting the upstream conduit. A support means is used to hold the intermediate conduit with the inlet end of the intermediate throat aligned with the upstream throat and the outlet end of the intermediate throat aligned with the downstream throat. The support means is also used to maintain a gap between the upstream and intermediate conduits and throats as well as a gap between the downstream and intermediate conduits and throats. A plurality of intermediate conduits may be placed in series between the upstream and downstream conduits. The support means may allow rotation of any one or all of the upstream, downstream, and intermediate conduits.

It is an advantage of the present invention to eliminate the need for float tanks to protect fluid supplies from contamination by backflow from fluid users induced by pressure drops or vacuums in the fluid supply.

It is an advantage of the present invention to provide a venting device for draining fluid-conducting lines when the lines become depressurized or inactive.

It is an advantage of the present invention to provide an in-line passive, continuous, and automatic vacuum breaking device, siphon breaking device, drain, and vent for a fluid-conducting conduit.

It is an advantage of the present invention to provide such a venting device which has no moving parts and which is relatively inexpensive to manufacture and maintain.

It is an advantage of the present invention to provide a venting device for a fluid-conducting/transmission system, the venting device being installed in the fluid-conducting system so that it receives and passes the full flow of the fluid-conducting system under normal operating conditions of the system with a minimal pressure drop across the device, and which serves as a vent, vacuum break, drain, or the like when the fluid-conducting system is inoperative.

It is an advantage of the present invention to provide an in-line venting device which accelerates fluid flowing in a conduit across a gap (the gap serving as a vent or vacuum break under appropriate flowing conditions) and which results in a pressure drop as little as 3% or less of the flowing fluid pressure.

BRIEF DESCRIPTION OF THE DRAWINGS

The present invention will be better understood by reference to the example of the following drawings.

DETAILED DESCRIPTION OF THE PREFERRED EMBODIMENTS

Figure 1:
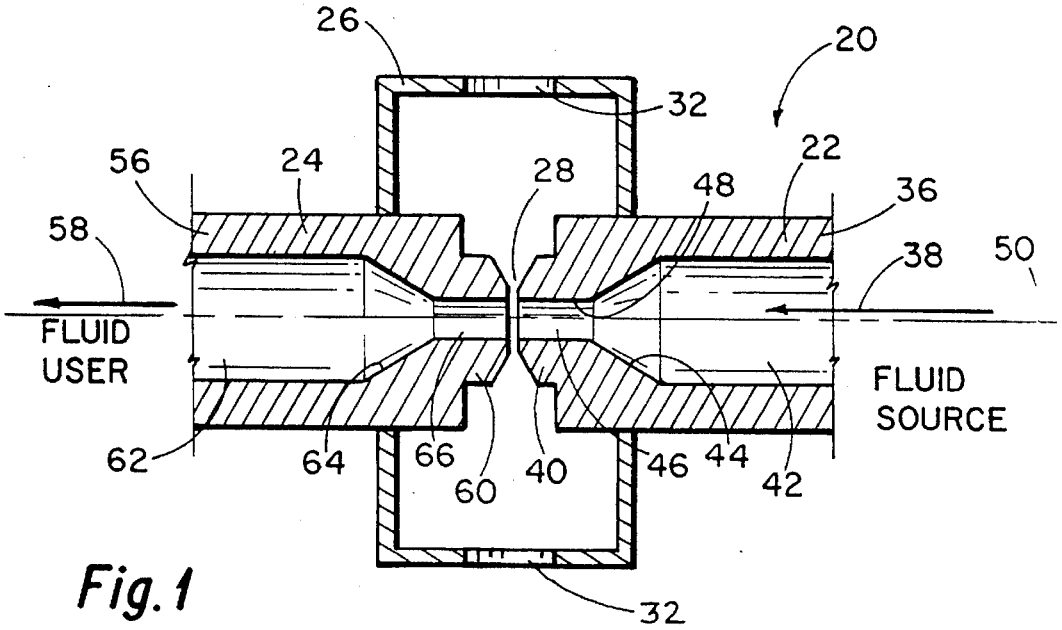
FIG. 1 is a sectional schematic diagram of an embodiment of a venting device and method of the present invention.

Preferred embodiments of the invention will now be described with reference to the drawings. Like reference characters refer to like or corresponding parts throughout the drawings and description.

Figure 2:
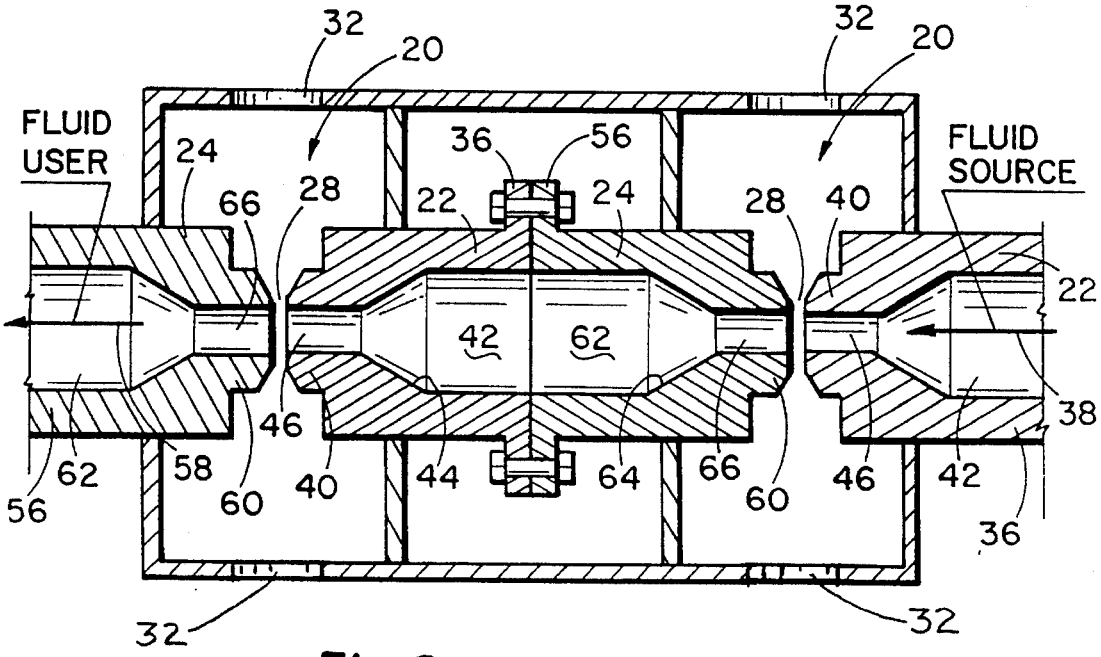
FIG. 2 is a sectional schematic diagram of another embodiment of a venting device and method of the present invention.
Figure 3:
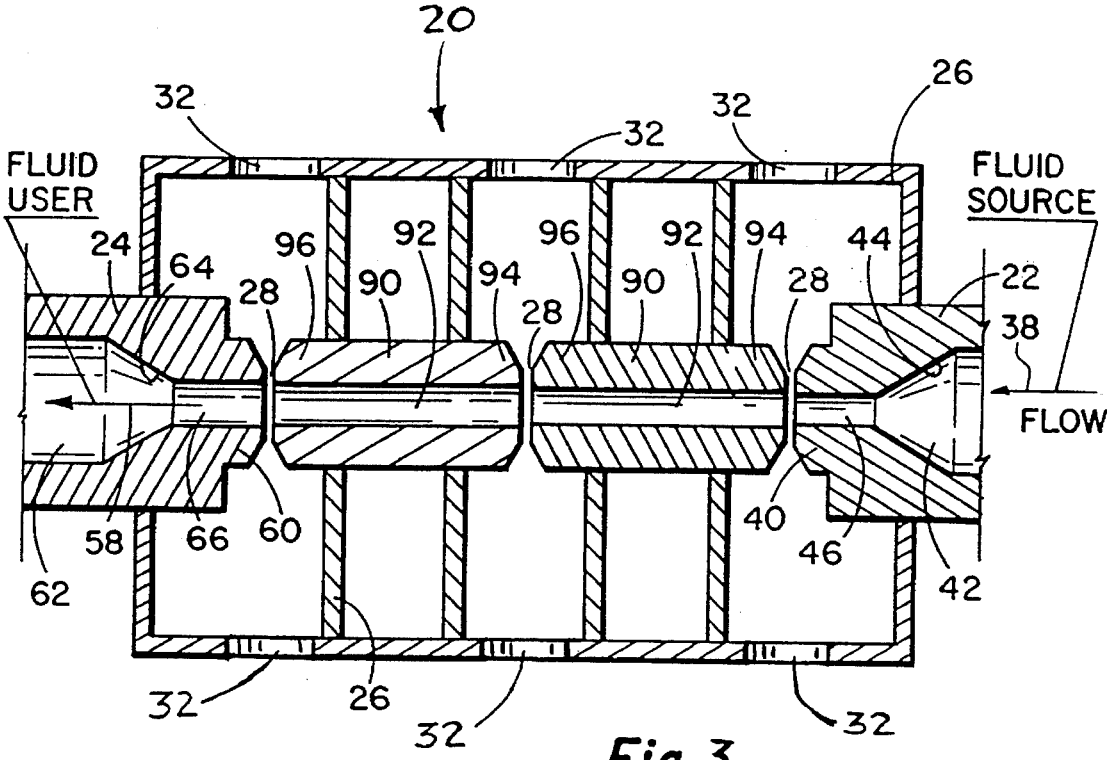
FIG. 3 is a sectional schematic diagram of another embodiment of a venting device and method of the present invention.

FIGS. 1–3 present embodiments of the device and method for venting a conduit and allowing fluid flow through the vented conduit, generally designated 20, of the present invention. Although the invention is generally referred to herein as a vent or venting device, it is intended to be understood that the invention has numerous utilitarian aspects, which include uses as a vent, vacuum or siphon break, surge arrester, overpressure protector, and the like. A contemplated application is as a vacuum or siphon breaking device which will protect a fluid supply from being contaminated by a fluid user downstream of the venting device. For example, the device 20 may be used in a car wash to prevent soap and chemicals from being "siphoned" into the water supply when the water supply pressure drops suddenly. In such a case, the suction or siphon created by the water supply will draw air in through the venting device 20 rather than drawing contaminated fluid from the downstream side of the venting device. Another contemplated application is as a drainage vent, such as may be used in a car wash to automatically and passively vent and cause the water to drain from the above-ground water lines when the car wash is inactive, thereby preventing freezing of the lines and eliminating the need to continuously run pumps and flush the inactive lines with water while the car wash system is inactive, as is currently the prevalent practice.

The venting device 20 may also be used in combination with the fluid-conducting swivel and method described in U.S. Pat. No. 5,284,298, owned by the assignee of the present invention, which is incorporated by reference herein for purposes of disclosure and/or with the fluid injection device and method described in U.S. patent application Ser. No. 08/176,801, filed by the Applicant of the present invention and now U.S. Pat. No. 5,386,941, which is incorporated herein by reference for purposes of disclosure.

Referring to the example of FIG. 1, the device 20 may be generally described as including an upstream conduit 22, a downstream conduit 24, and support means 26 for holding the upstream and downstream conduits 22, 24 in alignment and for maintaining a space or gap 28 between the upstream and downstream conduits 22, 24.

It is intended to be understood that the venting device 20 will normally be installed in a fluid-conducting conduit or system in which the device 20 will be inactive, e.g., the device 20 will be installed in a conduit and the fluid flowing in the conduit will pass through the device 20 and across gap 28 with virtually no effect on the flowing fluid. It is only when the fluid-conducting system or conduit is depressurized, inactive, or otherwise nonfunctional, such as when the pressure (or pressure drop) propelling the fluid across the device 20 and gap 28 drops below the pressure required to do so, that the device 20 begins to function as a vent, drain, or the like. By vent, venting, and the like is meant exposing the interior passageway of a conduit 22, 24 to the exterior environment surrounding and outside the conduits 22, 24, as does the open gap 28.

The upstream conduit 22 has a first end 36 connectable to a fluid source 38, a second end 40, and an upstream passageway 42 extending through the first and second ends 36, 40. The upstream passageway 42 also includes an acceleration nozzle 44 disposed in the upstream passageway 42 for accelerating the velocity of fluid flow through the upstream passageway 42 and an upstream throat 46 which extends between the acceleration nozzle 44 and the second end 40 of the upstream conduit 22 for maintaining the accelerated velocity of the fluid flow from the acceleration nozzle 44. The acceleration nozzle 44 and upstream throat 46 may be integral with or separate from the upstream conduit 22 and passageway 42.

The acceleration nozzle 44 reduces the size of the upstream passageway 42 and thereby provides a means for accelerating the velocity of the fluid flow to such a velocity that the pressure exerted by the fluid on the walls 48 of the upstream passageway 42 is substantially reduced, and preferably is reduced to such a point that the fluid exerts substantially no pressure on the walls 48 of the upstream throat 46. The acceleration nozzle 44 may also be described as providing a means for reducing the size of the upstream passageway 42 and thereby accelerating the velocity of the fluid flow to such a velocity that the fluid creates a substantially self-contained fluid jet which exerts little or no radially outward pressure and has little dissociation, particularly at points on the fluid jet in close proximity to its discharge from the second end 40 of the upstream conduit 22, as does a nozzle on a garden hose or high pressure air hose.

The preferred upstream throat 46 has a substantially constant cross-sectional area (in radial cross-section with respect to the axis 50) in order to maintain the accelerated velocity of the fluid flow and to maintain the self-contained fluid jet created by the acceleration nozzle 44. Preferably, the acceleration nozzle 44 is frusto-conically shaped (in axial cross-section), converges in the direction of fluid flow, and the converging walls of the nozzle 44 form an angle of 60° or less with the axis 50 of the upstream passageway 42 and upstream throat 46. The preferred upstream throat 46 maintains the reduced size of the upstream passageway 42 created by the acceleration nozzle 44 and extends the reduced size to the upstream conduit second end 40.

The downstream conduit 24 has a first end 56 connectable to a fluid user 58, a second end 60, and a downstream passageway 62 extending through the first and second ends 56, 60. The downstream passageway 62 also includes a deceleration nozzle 64 disposed in the downstream passageway 62 for decelerating the velocity of the fluid flow through the downstream passageway 62 (and thereby preventing the development of back pressure at the gap 28) and a downstream throat 66 which extends between the deceleration nozzle 64 and the second end 60 of the downstream conduit 24. The deceleration nozzle 64 and downstream throat 66 may be integral with or separate from the downstream conduit 24 and passageway 62.

The downstream throat 66 provides a means for receiving the accelerated fluid from the upstream throat 46 and maintaining the received fluid at substantially the same velocity as the velocity of the fluid exiting the upstream throat 46. The downstream throat 66 may also be characterized as receiving the accelerated fluid from the upstream throat 46 and maintaining a substantially constant mass flow and mass flow velocity in the upstream and downstream conduits 22,

24 and across the gap 28. The downstream throat 66 receives the substantially self-contained fluid jet from the upstream throat 46 before the discharged fluid jet has time to substantially expand or dissociate and is sized (in radial cross-section) to prevent expansion of the stream inside the throat 66. The downstream throat 66 may also be characterized as receiving the accelerated fluid and creating a fluid seal between the second end 60 of the downstream conduit 24 and the deceleration nozzle 64 in order to substantially prevent expansion of the accelerated fluid upstream of the deceleration nozzle 64.

The cross-sectional shape and area of the downstream throat 66 is selected or sized to maintain the fluid at substantially the same velocity (and mass flow rate) as the velocity (and mass flow rate) of the fluid exiting the upstream throat 44. The downstream passageway 62 and fluid user 58 should be selected or sized to allow fluid flow through the downstream conduit 24 without sufficient restriction to cause back pressure in the downstream throat 66 and gap 28.

The deceleration nozzle 64 provides a means for enlarging the size of the downstream passageway 62 and thereby decelerates the velocity of the fluid flow through the passageway 62. The preferred deceleration nozzle 64 is frusto-conically shaped (in axial cross-section), diverges in the direction of flow, and the walls of the nozzle 64 form an angle of 60° or less with the flow axis 50 of the downstream throat 66. Preferably, the acceleration and deceleration nozzles 44, 64 are substantially identical in design and equidistantly placed from the second ends 40, 60 of the upstream and downstream conduits 22, 24; although the nozzles 44, 64 may be placed at different distances from the second ends 40, 60, i.e., the throats 46, 66 may be of different lengths. In the prototype device 20, the nozzles 44, 64 and upstream and downstream throats 46, 66 are substantially symmetrical in axial cross-section, as exemplified in FIG. 1.

The gap 28, i.e., the distance between the second ends of the upstream and downstream conduits 22, 24 and throats 46, 66, will be determined or sized, based upon the circumference of the inside diameter of the downstream throat 66 and normal fluid-conducting conditions (pressure, flow, and other fluid properties), to prevent dissociation of the fluid received from the upstream conduit 22 and to maintain the fluid at a substantially constant velocity in the throat 66 downstream of the gap 28, as would be known to one skilled in the art in view of the disclosure contained herein. The outside surfaces of the adjacent second ends 40, 60 of the upstream and downstream conduits 22, 24 may be beveled or otherwise shaped to facilitate ingestion of air or other outside fluid during a vacuum relieving event, to facilitate drainage of fluid from the conduits 22, 24 through gap 28 when the conduits 22, 24 are depressurized or otherwise inactive, and the like. The sizing of the gap 28 should account for expansion characteristics of the materials of which the device 20 is constructed and should allow for thermal expansion and contraction of the materials at the expected operating temperatures of the device 20.

The space or gap 28 should be adjusted to minimize the pressure drop across the device 20 when the device 20 is not operating as a vent, i.e., when the system into which the device 20 is installed is in normal fluid-conducting operation. This may be accomplished by adjusting the space between the adjacent ends of the conduits 22, 24, and, depending upon the particular application, may result in a slightly positive pressure or slightly negative pressure on the outside of the conduits 22, 24 adjacent the gap. It is contemplated that it will normally be desirable to operate the device 20 in a manner which results in a minimum pressure loss across the device 20. It is also contemplated that, assuming, for example, a 95% pressure recovery across the device 20 is expected, the flow conditions and dimensions of the device 20 may be adjusted so that the 95% pressure recovery is achieved with either a negative pressure or a positive pressure created adjacent the gap 28 and outside the conduits 22, 24 by the fluid passing across the gap 28.

It is contemplated that the device 20 will work with liquid or gas, although gas will require a higher velocity to prevent dissociation of fluid at the gap 28. In any given application, it is contemplated that the conduits 22, 24, throats 46, 66, and nozzles 44, 64 should be sized, taking into account the fluid properties and operating pressures, as well as other relevant factors, so that the fluid velocity in the throats 46, 66 is high enough to prevent dissociation of the fluid stream at the gap 28 and is low enough to prevent developing a significant vacuum at the gap 28 when the device 20 is not operating as a vent, i.e., when the system into which the device 20 is installed is in normal fluid-conducting operation.

It is also contemplated that the internal diameter of the downstream throat 66 may be slightly larger than the upstream throat 46 to allow for slight misalignments between the upstream and downstream conduits 22, 24. Ideally, the upstream and downstream throats 46, 66 would be identically the same shape and internal diameter, if it were not necessary to compensate for alignment variations. It is contemplated that optimization of the dimensions and shapes of the fluid passageways 42, 62, nozzles 44, 64, and throats 46, 66 may result in pressure recoveries downstream of the deceleration nozzle 64 approaching 100% of the pressure applied upstream of the acceleration nozzle 44.

The support means 26 includes ports 32 for draining or removing fluids discharged from the gap 28 when the device 20 is acting as a drain and/or supplying air or other external fluid to the gap 28 when the device 20 is functioning as a vacuum or siphon breaking device and ingesting air to prevent siphoning of fluid from the fluid user 58 across the gap 28. The ports 32 may be connected to a drainage system, blanket gas system, air supply system, or the like, as would be known to one skilled in the art in view of the disclosure contained herein, as needed to satisfy the requirements of a specific use. An inert or blanket gas supply system may be connected to the ports 32 as necessary to accommodate the transmission of hazardous fluids across the gap 28.

Referring to the example of FIG. 2, a plurality of vent devices 20 may be connected in series in such a manner that the downstream conduit 24 of the adjacent upstream device 20 is the source of fluid for the upstream conduit 22 of the adjacent downstream device 20. It is contemplated that such a staged or sequenced device may be more effective by providing multiple gaps 28 through which the device 20 may vent. The selection and sizing considerations discussed above for the throat 66, nozzle 64, and passageway 62 downstream of each gap 28 would apply at each gap, i.e., the throat 66, nozzle 64, and passageway 62 downstream of each gap 28 should be sized to maintain the flow of the fluids at substantially the same velocity as the fluid exiting the upstream throat 46.

Referring to the example of FIG. 3, in another embodiment, an intermediate conduit 90 having an intermediate throat 92 extending between an inlet end 94 and an outlet end 96 is disposed between the upstream conduit 22 and downstream conduit 24. The inlet end 94 of the intermediate conduit 90 receives the fluid from the upstream throat 46 and maintains the received fluid at substantially the same velocity through the intermediate throat 92 as the fluid exiting the upstream conduit 22.

The support means 26 holds the intermediate conduit 90 with the inlet end 94 of the intermediate throat 92 aligned with the upstream throat 46 and the outlet end of the intermediate throat 92 aligned with the downstream throat 66 and maintains a gap 28 between the upstream and intermediate conduits 22, 90 and throats 46, 92 and maintains a gap 28 between the downstream and intermediate conduits 24, 90 and throats 66, 92. The cross-sectional areas of the intermediate and downstream throats 92, 66, nozzle 64, and passageway 62 should be sized, taking into account the relevant pressure, volume, and other related fluid conditions to maintain the flow of fluid passing through the intermediate and downstream throats 92, 66 at substantially the same velocity as the fluid exiting the upstream throat 46.

As exemplified in FIG. 3, a plurality of intermediate conduits 90 may be disposed between the upstream conduit 22 and downstream conduit 24 with the support means 26 supporting the conduits 90 and maintaining a gap 28 between each of the adjacent conduits 22, 24, 90. Only one upstream conduit 22 and downstream conduit 24 (with acceleration and deceleration nozzles 44, 64 and upstream and downstream throats 46, 66) are required as long as the velocity of the accelerated fluid is maintained sufficiently to sustain the fluid jet and essentially zero pressure exerted by the accelerated fluid on the walls of the upstream and downstream throats 46, 66 and intermediate throat 92. Additional upstream and downstream conduits 22, 24 can be added if needed to maintain the fluid velocity, as exemplified in FIG. 2. In all embodiments of the invention, the fluid user 58 should be selected or sized to allow fluid flow through the device 20 without causing undesired back pressure or vacuum in the throats 46, 66, 92 or in the gaps 28 during normal fluid-conducting operations.

The support means 26 may be designed to allow rotation of any or all of the upstream, downstream, and intermediate conduits 22, 24, 90, as would be known to one skilled in the art in view of the disclosure contained herein. For example, in the examples of FIGS. 1–3, the support means 26 may be made of a material which, in conjunction with the materials of the conduits 22, 24, 90, facilitates the desired rotation.

Referring to the example of FIG. 1, the method of venting a conduit and flowing fluid through the vented conduit includes accelerating the velocity of the fluid flowing in an upstream passageway 42 from a first end 36 through a second end 40 of an upstream conduit 22 so that the pressure exerted by the fluid on the walls of the upstream passageway 42 is substantially reduced; receiving the fluid discharged from the second end 40 of the upstream conduit 22 in a downstream passageway 62 in the second end 60 of a downstream conduit 24, the downstream passageway 62 extending through a first end 56 of the downstream conduit 24; holding the upstream and downstream conduits 22, 24 with the upstream and downstream passageways 42, 62 aligned; maintaining a gap 28 between the adjacent second ends 40, 60 of the upstream and downstream conduits 22, 24; and maintaining the fluid velocity in the downstream passageway 62 substantially the same as the velocity of the fluid exiting the upstream conduit 22. The method includes selecting a cross-sectional area of the downstream passageway 62 to maintain the flow of the fluid through the downstream conduit 24 at substantially the same velocity (and/or mass flow) as the fluid exiting the upstream conduit 22.

The method provides for reducing the size of the fluid passageway with an acceleration nozzle 44 disposed in the upstream conduit 22 and thereby accelerating the fluid velocity to such a velocity that the fluid exerts substantially no pressure on the walls of the upstream fluid passageway 42. The method also provides for reducing the size of the upstream fluid passageway 42 with an acceleration nozzle 44 disposed in the upstream conduit 22 and thereby accelerating the velocity of the fluid flow to such a velocity that the fluid creates a substantially self-contained fluid jet. Preferably, the upstream conduit 22 includes an upstream throat 46 having a substantially constant cross-sectional area in order to maintain the velocity of the self-contained fluid jet.

In a preferred method the upstream passageway 42 includes an acceleration nozzle 44 for accelerating the velocity of the fluid; and an upstream throat 46 extending from the acceleration nozzle 44 to the second end of the upstream conduit 22 for maintaining the accelerated velocity of the fluid. The downstream passageway 62 includes a deceleration nozzle 64 for decelerating the velocity of the fluid and a downstream throat 66 extending from the deceleration nozzle 64 to the second end 60 of the downstream conduit 24 for maintaining the fluid flow velocity between the upstream throat 46 and the deceleration nozzle 64. Preferably, the downstream throat 66 has substantially the same cross-sectional area and shape as the upstream throat 46 in order to substantially prevent dissociation and expansion of the fluid between the upstream and downstream throats 46, 66. By so doing, the downstream throat 66 is contemplated as maintaining the fluid flow at a substantially constant velocity between the upstream throat 46 and the deceleration nozzle 64. The downstream throat 66 is also defined as receiving the accelerated fluid and creating a fluid seal between the second end 60 of the downstream conduit and the deceleration nozzle 64 in order to substantially prevent expansion of the accelerated fluid upstream of the deceleration nozzle 64.

Referring to the example of FIG. 2, the method further provides for connecting a plurality of the upstream and downstream conduits 22, 24 in series in such a manner that the second ends 40 of the upstream conduits 22 are always adjacent a second end 60 of a downstream conduit 24 with a gap 28 between the adjacent second ends 40, 60. The method provides for rotatably mounting either or both of the upstream and downstream conduits 22, 24.

Referring to the example of FIG. 3, the method provides for holding an intermediate conduit 90 having an intermediate throat 92 extending between an inlet end 94 and an outlet end 96 between the upstream conduit 22 and the downstream conduit 24 such that the 25 inlet end 94 of the intermediate conduit 90 is aligned with the upstream passageway 42 of the upstream conduit 22, the outlet end 96 of the intermediate throat 90 is aligned with the downstream passageway 62 of the downstream conduit 24, a gap 28 is maintained between the upstream and intermediate conduits 22, 90, and a gap 28 is maintained between the downstream and intermediate conduits 24, 90; receiving the accelerated fluid from the upstream conduit 22 in the inlet end 94 of the intermediate throat 92; and maintaining the received fluid at substantially the same velocity through the intermediate throat 92 as the fluid exiting the upstream conduit 22. The method provides for selecting the cross-sectional area of each of the intermediate and downstream throats 92, 66 and the downstream passageway 62 to maintain the fluid flow velocity through the intermediate and downstream throats 92, 66 at substantially the same velocity as the fluid exiting the upstream throat 46. The method provides for holding a plurality of intermediate conduits 90 in an inlet end 94 to outlet end 96 sequence between the upstream conduit 22 and the downstream conduit 24 and maintaining a gap 28 between each of the adjacent conduits 22, 24, 90. The method further provides for rotatably mounting any or all of the upstream, downstream, and intermediate conduits 22, 24, 90.

In operation of the device and method 20, the first end 36 of the upstream conduit 22 is connected to a fluid source 38 and the second end 56 of the downstream conduit 24 is connected to a fluid user 58. As previously discussed, the device 20 is sized so that at the normal operating conditions of the fluid source 38 and fluid user 58, the fluid flows through the upstream and downstream passageways 42, 62 and crosses the gap 28 with minimal loss in pressure across the device and substantially no leakage of fluid at the gap 28 or ingestion of air or other external fluid from outside the device 20 into the gap 28 and fluid passing from the upstream conduit 22 to the downstream conduit 24. When the normal operating or flow conditions deviate significantly from the design conditions, the device 20 will function as a venting device. For example, when the system into which the device 20 is installed is depressurized, shut down, inactive, obstructed, or otherwise operationally impaired, the device 20 acts as a vent or drain which will allow fluid to escape through the gap 28; or which will inspire or ingest fluid from outside the gap 28 and conduits 22, 24 into the conduits 22, 24 and allow the device 20 to drain fluid from the fluid source 38 and/or fluid user 58 through the gap and/or act as a vacuum or siphon break which will prevent induced flow across the gap 28 and device 20. In other words, the device 20 allows positively pressured/propelled flow across the gap 28 but prevents induced or siphoned flow across the gap 28, as well as facilitating drainage of fluid when the fluid source 38 and/or fluid user 58 is depressurized, inactive, or operationally impaired. Since the device 20 is installed in-line, i.e., the full flow of the fluid from the fluid source 38 to the fluid user 58 passes through the device 20 and across gap 28, the device 20 provides a passive and continuous drain and vent which will also function as an overpressure/surge arrester and will discharge excess pressure and fluid through the gap 28 should a spike or surge of overpressure occur, such as may be caused by water hammer or the like.

The device 20 may be sized so that it has minimal effect on the fluid flow from the fluid source to the fluid user under normal operating conditions and will only begin to function as a vent or vacuum break when the fluid source 38 and/or fluid user 58 for the fluid-conducting system to which the device 20 is installed is depressurized, inactive, or drops below a minimum flow and/or pressure level.

While presently preferred embodiments of the invention have been described herein for the purpose of disclosure, numerous changes in the construction and arrangement of parts and the performance of steps will suggest themselves to those skilled in the art in view of the disclosure contained herein, which changes are encompassed within the spirit of this invention, as defined by the following claims.

What is claimed is:

1. A device for venting a conduit and allowing fluid flow through the conduit, comprising:

(a) an upstream conduit having a first end connectable to a fluid source, a second end, and a fluid passageway extending through the first and second ends, the upstream conduit comprising:

an acceleration nozzle disposed in the fluid passageway for accelerating the velocity of the fluid flow; and an upstream throat, extending between the acceleration nozzle and the second end of the upstream conduit, for maintaining the accelerated velocity of the fluid flow from the acceleration nozzle;

(b) a downstream conduit having a first end connectable to a fluid user, a second end, and a fluid passageway extending through the first and second ends, the downstream conduit comprising:

a deceleration nozzle disposed in the fluid passageway for decelerating the velocity of the fluid flow; and a downstream throat, extending between the deceleration nozzle and the second end of the downstream conduit, for receiving the accelerated fluid from the upstream throat and maintaining the accelerated fluid at substantially the same velocity as the fluid exiting the upstream throat; and (c) support means for holding the upstream and downstream conduit with the upstream and downstream throats aligned and for maintaining a gap between the upstream and downstream conduit and between the upstream and downstream throats.

2. Device of claim 1:

wherein the acceleration nozzle is defined as reducing the size of the fluid passageway and thereby accelerating the velocity of the fluid flow to such a velocity that the fluid exerts substantially no pressure on the walls of the upstream throat.

3. Device of claim 1:

wherein the acceleration nozzle is defined as reducing the size of the fluid passageway and thereby accelerating the velocity of the fluid flow to such a velocity that the fluid creates a substantially self-contained fluid jet.

4. Device of claim 3:

wherein the upstream throat is defined as extending the reduced size of the fluid passageway and having a substantially constant cross-sectional area in order to maintain the self-contained fluid jet.

5. Device of claim 1:

wherein the downstream throat is defined as having substantially the same cross-sectional area and shape as the upstream throat in order to substantially prevent dissociation and expansion of the fluid between the upstream and downstream throats.

6. Device of claim 5:

wherein the downstream throat is defined as maintaining the fluid flow at a substantially constant velocity between the upstream throat and the deceleration nozzle.

7. Device of claim 1:

wherein the downstream throat is defined as receiving the accelerated fluid and creating a fluid seal between the second end of the downstream conduit and the deceleration nozzle in order to substantially prevent expansion of the accelerated fluid upstream of the deceleration nozzle.

8. Device of claim 1, comprising:

a plurality of the devices connected in series in such a manner that the downstream conduit of the adjacent upstream device is the fluid source for the upstream conduit of the adjacent downstream device.

9. Device of claim 8:

wherein the support means is further defined as allowing rotation of either or both of the upstream and downstream conduits.

10. Device of claim 1, comprising:

an intermediate conduit having an intermediate throat extending between an inlet end and an outlet end disposed between the upstream conduit and the downstream conduit, the inlet end of the intermediate conduit receiving the accelerated fluid from the upstream throat and maintaining the received fluid at substantially the same velocity through the intermediate throat as the fluid exiting the upstream conduit; and wherein the support means is further defined as holding the intermediate conduit with the inlet end of the intermediate throat aligned with the upstream throat and the outlet end of the intermediate throat aligned with the downstream throat, as maintaining a gap between the upstream and intermediate conduits and throats, and as maintaining a gap between the downstream and intermediate conduits and throats.

11. Device of claim 10:

wherein the cross-sectional area of each of the intermediate and downstream throats and the downstream passageway is selected to maintain the fluid flow velocity through the intermediate and downstream throats at substantially the same velocity as the fluid exiting the upstream throat.

12. Device of claim 10, comprising:

a plurality of intermediate conduits disposed between the upstream conduit and the downstream conduit; and wherein the support means is further defined as maintaining a gap between each of the adjacent conduits.

13. Device of claim 10:

wherein the support means is further defined as allowing rotation of any or all of the upstream, downstream, and intermediate conduits.

14. A method of venting a conduit and flowing fluid through the vented conduit, comprising:

(a) accelerating the velocity of a fluid flowing in an upstream passageway from a first end through a second end of an upstream conduit so that the pressure exerted by the fluid on the walls of the upstream passageway is substantially reduced;

(b) receiving the fluid discharged from the second end of the upstream conduit in a downstream passageway in the second end of a downstream conduit, the downstream passageway extending through a first end of the downstream conduit;

(c) holding the upstream and downstream conduits with the upstream and downstream passageways aligned;

(d) maintaining a gap between the adjacent second ends of the upstream and downstream conduits; and (e) maintaining the fluid velocity in the downstream passageway substantially the same as the velocity of the fluid exiting the upstream conduit.

15. Method of claim 14, comprising:

selecting the cross-sectional area of the downstream passageway to maintain the flow of the fluid through the downstream conduit at substantially the same velocity as the fluid exiting the upstream conduit.

16. Method of claim 14 in which step (a) comprises:

reducing the size of the fluid passageway with an acceleration nozzle disposed in the upstream conduit and thereby accelerating the fluid velocity to such a velocity that the fluid exerts substantially no pressure on the walls of the fluid passageway.

17. Method of claim 14 in which step (a) comprises:

reducing the size of the fluid passageway with an acceleration nozzle disposed in the upstream conduit and thereby accelerating the velocity of the fluid flow to such a velocity that the fluid creates a substantially self-contained fluid jet.

18. Method of claim 17 in which the upstream conduit comprises:

an upstream throat having a substantially constant cross-sectional area in order to maintain the velocity of the self-contained fluid jet.

19. Method of claim 14;

in which the upstream passageway comprises:

an acceleration nozzle for accelerating the velocity of the fluid; and an upstream throat, extending from the acceleration nozzle to the second end of the upstream conduit, for maintaining the accelerated velocity of the fluid; and in which the downstream passageway comprises:

a deceleration nozzle for decelerating the velocity of the fluid; and a downstream throat, extending from the deceleration nozzle to the second end of the downstream conduit, for maintaining the fluid flow velocity between the upstream throat and the deceleration nozzle.

20. Method of claim 19:

wherein the downstream throat is defined as having substantially the same cross-sectional area and shape as the upstream throat in order to substantially prevent dissociation and expansion of the fluid between the upstream and downstream throats.

21. Method of claim 20:

wherein the downstream throat is defined as maintaining the fluid flow at a substantially constant velocity between the upstream throat and the deceleration nozzle.

22. Method of claim 19:

wherein the downstream throat is defined as receiving the accelerated fluid and creating a fluid seal between the second end of the downstream conduit and the deceleration nozzle in order to substantially prevent expansion of the accelerated fluid upstream of the deceleration nozzle.

23. Method of claim 14, comprising:

connecting a plurality of the upstream and downstream conduits in series in such a manner that the second ends of the upstream conduits are always adjacent a second end of a downstream conduit with a gap between the adjacent second ends.

24. Method of claim 23, comprising:

rotatably mounting either or both of the upstream and downstream conduits.

25. Method of claim 14, comprising:

(a) holding an intermediate conduit having an intermediate throat extending between an inlet end and an outlet end between the upstream conduit and the downstream conduit such that the inlet end of the intermediate conduit is aligned with the upstream passageway of the upstream conduit, the outlet end of the intermediate throat is aligned with the downstream passageway of the downstream conduit, a gap is maintained between the upstream and intermediate conduits, and a gap is maintained between the downstream and intermediate conduits;

(b) receiving the accelerated fluid from the upstream conduit in the inlet end of the intermediate throat; and (c) maintaining the received fluid at substantially the same velocity through the intermediate throat as the fluid exiting the upstream conduit.

26. Method of claim 25;

in which the upstream passageway comprises:

an acceleration nozzle for accelerating the velocity of the fluid; and an upstream throat, extending from the acceleration nozzle to the second end of the upstream conduit, for maintaining the accelerated velocity of the fluid; and in which the downstream passageway comprises:

a deceleration nozzle for decelerating the velocity of the fluid; and a downstream throat, extending from the deceleration nozzle to the second end of the downstream conduit, for maintaining the fluid flow velocity between the upstream throat and the deceleration nozzle.

27. Method of claim 26, comprising:

selecting the cross-sectional area of each of the intermediate and downstream throats and the downstream passageway to maintain the fluid flow velocity through the intermediate and downstream throats at substantially the same velocity as the fluid exiting the upstream throat.

28. Method of claim 25, comprising:

holding a plurality of intermediate conduits in an inlet end to outlet end sequence between the upstream conduit and the downstream conduit and maintaining a gap between each of the adjacent conduits.

29. Method of claim 25, comprising:

rotatably mounting any or all of the upstream, downstream, and intermediate conduits.

* * * * *